US009816708B2

(12) United States Patent
Bothien et al.

(10) Patent No.: US 9,816,708 B2
(45) Date of Patent: Nov. 14, 2017

(54) METHOD FOR OPERATING A COMBUSTION DEVICE INCLUDING INJECTING A FLUID TOGETHER WITH DILUENT FUEL TO ADDRESS COMBUSTION PULSATIONS

(75) Inventors: Mirko Ruben Bothien, Zürich (CH); Martin Zajadatz, Küssaberg/Dangstetten (DE); Douglas Anthony Pennell, Windisch (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 1143 days.

(21) Appl. No.: 13/592,812

(22) Filed: Aug. 23, 2012

(65) Prior Publication Data

US 2013/0067925 A1 Mar. 21, 2013

(30) Foreign Application Priority Data

Aug. 30, 2011 (EP) ..... 11179344

(51) Int. Cl.

| | |
|---|---|
| ***F23R 3/36*** | (2006.01) |
| ***F23K 5/10*** | (2006.01) |
| ***F23L 7/00*** | (2006.01) |
| ***F23R 3/28*** | (2006.01) |

(52) U.S. Cl.

CPC ..... *F23R 3/36* (2013.01); *F23K 5/10* (2013.01); *F23L 7/002* (2013.01); *F23R 3/28* (2013.01); *F23L 2900/07003* (2013.01); *F23R 2900/00013* (2013.01)

(58) Field of Classification Search

CPC .... F23R 3/36; F23R 3/28; F23R 2900/00013; F23R 3/343; F23R 3/346; F23K 5/10; F23L 2900/00; F23L 2900/07003; F02C 3/30

See application file for complete search history.

(56) References Cited

U.S. PATENT DOCUMENTS

| | | | | |
|---|---|---|---|---|
| 4,541,383 A * | 9/1985 | Jessel | F02D 19/12 | 123/25 R |
| 6,558,154 B2 * | 5/2003 | Eroglu | F02C 9/28 | 431/351 |
| 6,769,903 B2 * | 8/2004 | Hellat | F23C 7/002 | 431/12 |

(Continued)

FOREIGN PATENT DOCUMENTS

| | | | |
|---|---|---|---|
| CH | EP 2299091 A1 * | 3/2011 | F02C 3/22 |
| DE | 10160907 A1 | 8/2003 | |

(Continued)

OTHER PUBLICATIONS

Office Action dated Jul. 1, 2014, by the Russian Patent Office in corresponding Russian Patent Application No. 2012136957, and an English Translation of the Office Action. (6 pages).

(Continued)

*Primary Examiner* — William H Rodriguez

(74) *Attorney, Agent, or Firm* — Buchanan Ingersoll & Rooney PC

(57) ABSTRACT

A method for operating a combustion device includes supplying a fuel and an oxidizer into the combustion device and burning them. According to the method, during at least a part of a transient operation, an additional fluid is supplied together with the fuel, and its amount is regulated to counteract combustion pulsations.

18 Claims, 4 Drawing Sheets

(56) References Cited

U.S. PATENT DOCUMENTS

| | | | | |
|---|---|---|---|---|
| 8,973,366 | B2 * | 3/2015 | Zhang et al. | 60/734 |
| 9,017,064 | B2 * | 4/2015 | Wasif | 431/2 |
| 2004/0265136 | A1 * | 12/2004 | Martling et al. | 417/53 |
| 2006/0042258 | A1 * | 3/2006 | Gadde et al. | 60/772 |
| 2007/0089425 | A1 * | 4/2007 | Motter et al. | 60/775 |
| 2009/0249792 | A1 | 10/2009 | Guethe et al. | |
| 2010/0146984 | A1 | 6/2010 | Carroni et al. | |
| 2010/0175382 | A1 * | 7/2010 | Eroglu | F23C 6/047 60/748 |
| 2011/0126546 | A1 * | 6/2011 | Meeuwissen | F02C 6/003 60/772 |
| 2012/0247116 | A1 * | 10/2012 | Meeuwissen | F02C 3/22 60/772 |
| 2013/0125547 | A1 * | 5/2013 | Bothien et al. | 60/722 |
| 2015/0020530 | A1 * | 1/2015 | Pandey et al. | 60/772 |

FOREIGN PATENT DOCUMENTS

| | | | |
|---|---|---|---|
| EP | 2 107 227 | A1 | 10/2009 |
| EP | 2213863 | A2 | 8/2010 |
| EP | 2213941 | A2 | 8/2010 |
| SU | 1028949 | A | 7/1983 |

OTHER PUBLICATIONS

Office Action dated Apr. 30, 2015, by the Russian Patent Office in corresponding Russian Patent Application No. 2012136957, and an English Translation of the Office. (11 pages).

* cited by examiner

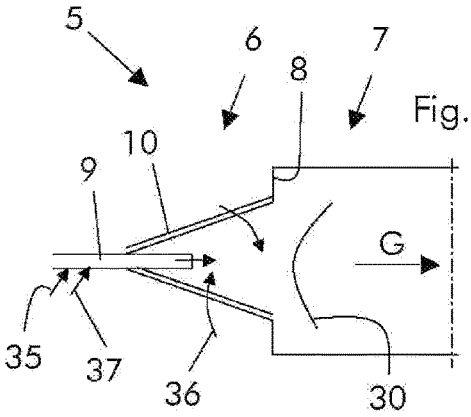
Fig. 4
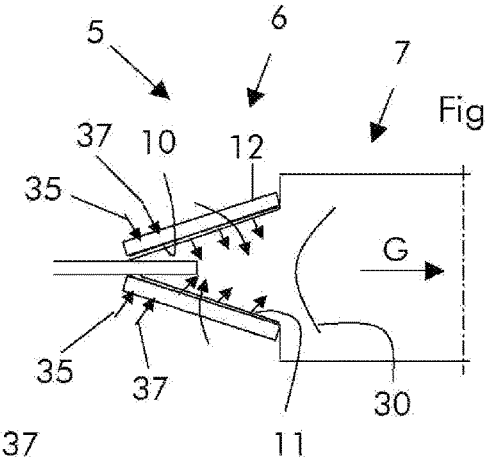
Fig. 5
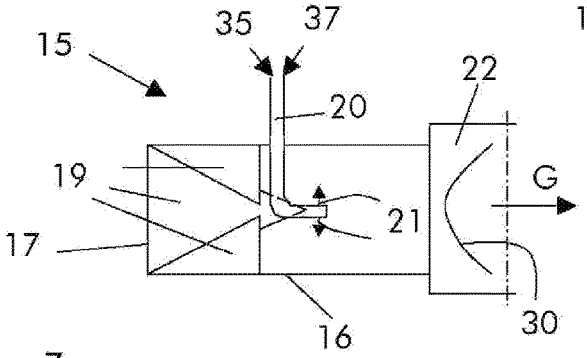
Fig. 6
Fig. 7
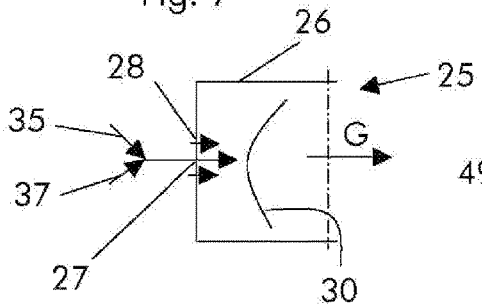
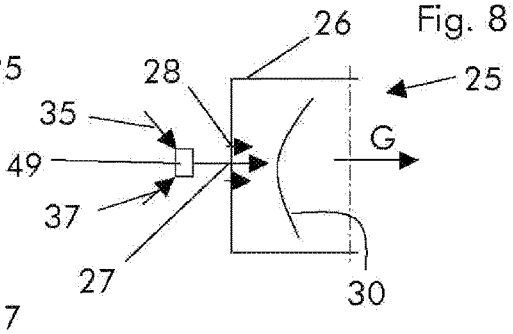
Fig. 8
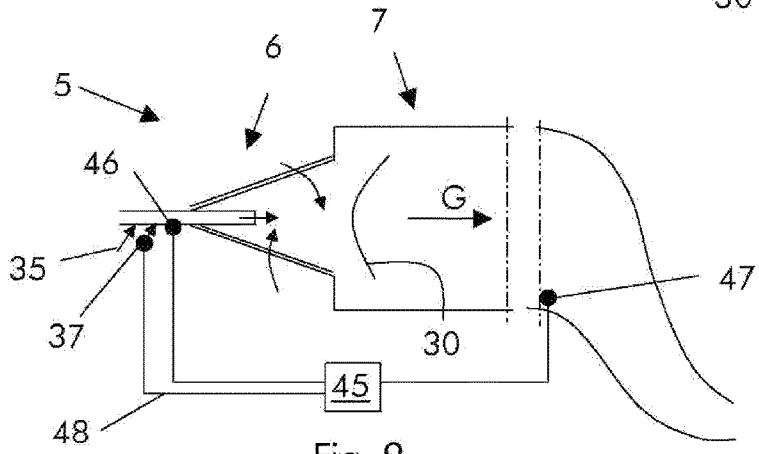
Fig. 9

METHOD FOR OPERATING A COMBUSTION DEVICE INCLUDING INJECTING A FLUID TOGETHER WITH DILUENT FUEL TO ADDRESS COMBUSTION PULSATIONS

CROSS-REFERENCE TO RELATED APPLICATIONS

This application claims benefit under 35 USC §119 to European Patent Application No. 11179344.4 filed Aug. 30, 2011, the entire contents of which are incorporated by reference herein as if fully set forth.

FIELD OF THE INVENTION

The present invention relates to a method for operating a combustion device. In particular, the method according to the invention allows operation of a combustion device with reduced pulsations. Preferably the combustion device is a part of a gas turbine.

BACKGROUND

In the following particular reference to combustion devices that are part of a gas turbine is made; it is anyhow clear that the method can also be implemented in combustion devices for different applications. Thus, before the combustion device a compressor and after the combustion device a turbine are typically provided.

Combustion devices are known to include a body with a fuel supply for either a liquid fuel (for example oil) or a gaseous fuel (for example natural gas) and an oxidizer supply (usually air).

During operation, the fuel and the oxidizer react within the combustion device and generate high pressure and temperature flue gases that are expanded in a turbine.

During transient operation, such as for example when the gas turbine is started up, switched off, during fuel switch over or also during other transient operations, problems can occur.

In fact, during transient operations pressure waves can generate within the combustion device.

FIG. 1 shows an example of a possible circumferential pressure wave (it can be a static or a rotating pressure wave). FIG. 1 shows the pressure P as a function of the angular position $\phi$ over the combustion device at a period in time t=t0 (solid line) and t=t1 (dashed line). From this figure it is apparent that an injector located at a position $\phi$1:

at the period in time t=t0 faces an environment at a low pressure P1; this promotes fuel supply through the injector; and at the period in time t=t1 faces an environment at a high pressure P2; this hinders fuel supply through the injector.

Likewise, FIG. 2 shows an example of a possible axial pressure wave. FIG. 2 shows the pressure P as a function of the axial position x (L indicates the combustion device length) at a period in time t=t0 (solid line) and t=t1 (dashed line).

Also in this case, an injector will face a combustion device having a pressure that fluctuates with time; as explained above, this fluctuating pressure adversely influences fuel injection.

FIG. 3 shows the effect of the fluctuating pressure within the combustion device on the fuel injection. In particular FIG. 3 shows an example in which the fuel mass flow is reduced; this could be an example of a switch off, nevertheless the same conditions are also present at the beginning of a start up or at the beginning and end of a switch over and in general each time the fuel mass flow supplied decreases and falls below a given mass flow.

FIG. 3 shows the fuel mass flow M injected through an injector as a function of time t. From FIG. 3 at least the following phases can be recognized:

before t=t3: steady operation with substantially constant fuel mass flow through the injector (curve 1), between t=t3 and t=t4 (the fuel mass flow stays above a critical fuel mass flow Mc): the amount of fuel injected decreases, but the fluctuating pressure within the combustion device does not noticeably affect fuel injection (curve 2), after t=t4 (i.e. when the fuel mass flow falls below the critical fuel mass flow Mc): in these conditions, since the amount of fuel is low, the fluctuating pressure within the combustion device alternatively promotes and hinders fuel injection, causing a fluctuating fuel injection. In particular in FIG. 3, curve 2 shows a theoretical run of the reducing fuel mass flow and curve 3 an example of a possible real run of the reducing fuel mass flow.

Fluctuating fuel supply into the combustion device generates large combustion pulsations.

Combustion pulsations, largely mechanically and thermally, stress the combustion device and the turbine downstream of it, therefore they must be counteracted.

SUMMARY

An aspect of the present invention thus includes providing a method by which combustion pulsations generated during transient operation are counteracted.

This and further aspects are attained by providing a method in accordance with the accompanying claims.

BRIEF DESCRIPTION OF THE DRAWINGS

Further characteristics and advantages of the invention will be more apparent from the description of a preferred but non-exclusive embodiment of the method, illustrated by way of non-limiting example with reference to the accompanying drawings, in which:

FIGS. 4 through 9 show different combustion devices that can implement the method.

DETAILED DESCRIPTION OF THE PREFERRED EMBODIMENTS

Figure 1:
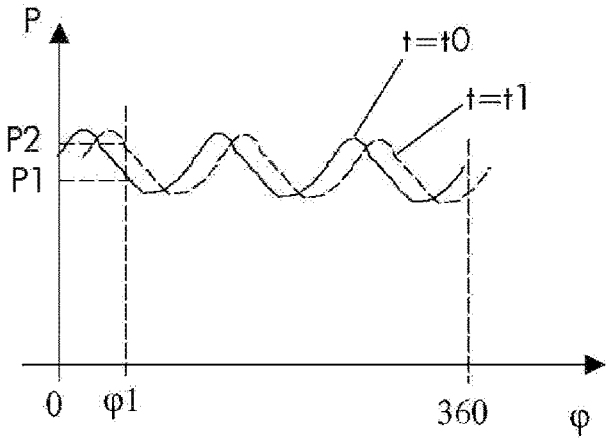
FIGS. 1 and 2 schematically show the pressure waves P within the combustion device as a function of the circumferential angle $\phi$ or axial position x at two different periods in time t0 and t1.
Figure 2:
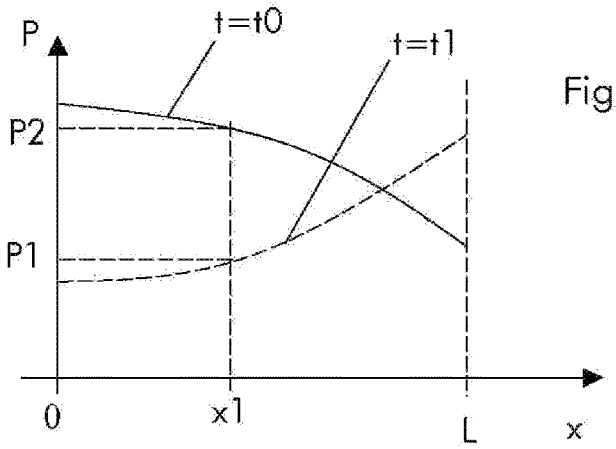

The method can be implemented with any kind of combustion device, for example adapted to generate a premixed flame, a diffusion flame, a mixed flame, etc.

For example the combustion device can be a premixed combustion device 5 (FIG. 4), with conical swirl chamber 6 and combustion chamber 7 extending downstream of the swirl chamber 6; a front plate 8 is provided between them. This combustion device further includes fuel supply (for example a lance 9 that typically injects a liquid fuel) and tangential slits 10 at the swirl chamber 6 for oxidizer supply (typically air). Additional fuel supply includes injectors 11 (FIG. 5) provided on lines 12 that are connected to the wall of the swirl chamber 6, at positions close to the slits 10, for fuel injection (typically gaseous fuel). This kind of combustion device 5 is well known and is schematically shown in FIGS. 4, 5 and 9.

A different kind of premixed combustion devices 15 is for example schematically shown in FIG. 6. This combustion device 15 includes a body 16 (for example a tubular body with square or trapezoidal cross section) with an inlet 17 and outlet. Within the body 16, vortex generators 19 (for example tetrahedral vortex generators but also different shapes and concepts are possible) and fuel supply including a lance 20 with fuel injectors 21 are housed. Downstream of the body 16, a combustion chamber 22 is provided.

FIGS. 7 and 8 show further examples of combustion devices that are arranged to generate a diffusion flame.

These combustion devices 25 have a body 26 with fuel supply including fuel injectors 27 (liquid or gaseous fuel) and oxidizer supply including oxidizer injectors 28.

In all the figures, reference 30 indicates the flame and reference G indicates the hot gases generated in the combustion device and directed toward the turbine.

Figure 3:
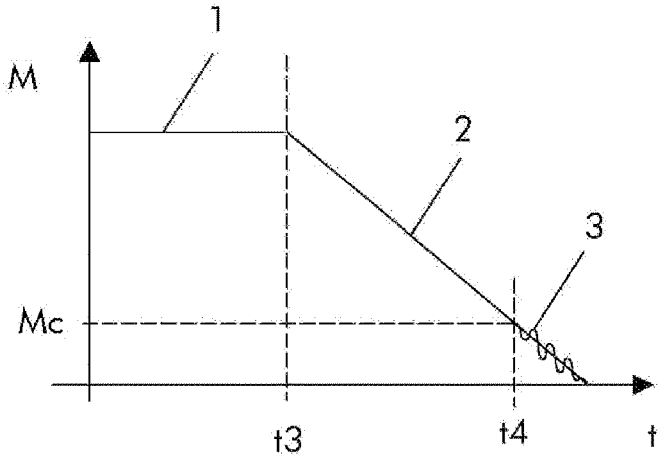
FIG. 3 schematically shows the mass flow injected into the combustion device as a function of the time t.

In the following, particular reference to the embodiment of FIG. 3 is made; it is anyhow clear that the same method can be implemented in all kind of combustion devices (i.e. those described or others).

The method for operating a combustion device 5 comprises supplying a fuel 35 and an oxidizer 36 into the combustion device 5 and burning them.

In addition, during at least a part of a transient operation such as for example a start up, a switch off or a switch over, an additional fluid 37 is supplied into the combustion device 5 together with the fuel 35.

The additional fluid 37 is advantageously supplied through the same injectors as the fuel 35 and it is typically at least partly mixed with the fuel 35.

The amount of the additional fluid 37 is thus regulated to counteract combustion pulsations.

Figure 14:
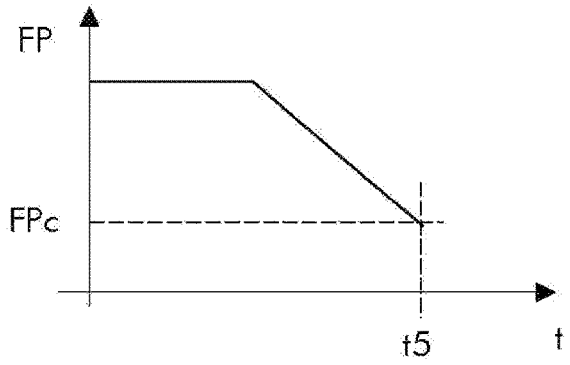

With reference to FIG. 14, a first parameter FP indicative of the fuel feed is chosen and the additional fluid supply starts only when the first parameter reaches a critical value FPc. The critical value FPc can be chosen such that when the first parameter reaches or passes it, pulsations start to generate or to substantially generate. In this respect FIG. 14 shows the first parameter FP and its critical value FPc; supply of the additional fuel starts only at t5, when the first parameter reaches its critical value FPc.

In different examples, the first parameter can be the fuel mass flow M or the differential pressure ΔP between a fuel supply and the inside of the combustion device 5; in these cases additional fluid supply starts when the fuel amount supplied into the combustion device or the differential pressure falls below the critical value Mc or ΔPc.

Figure 15:
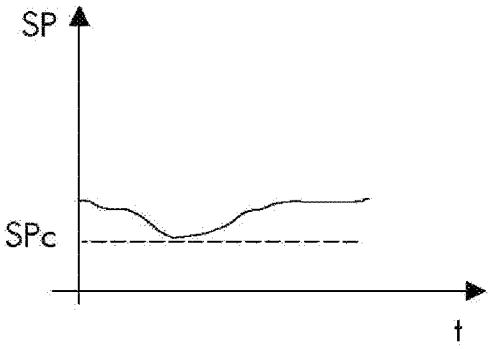
Figure 16:
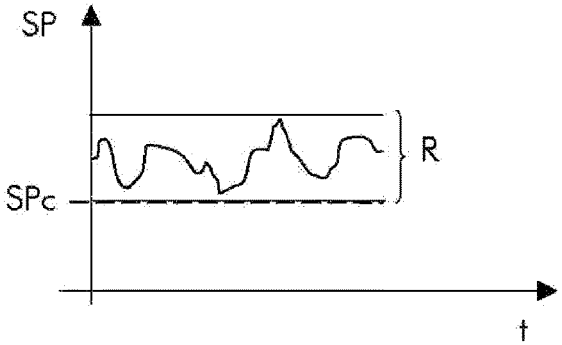

In addition, a second parameter SP indicative of the fuel and additional fluid feed is also chosen; the regulation includes maintaining the second parameter above or below a given value (FIG. 15) or preferably maintaining the second parameter SP within a prefixed range R (FIG. 16).

The given value can be a critical value SPc of the second parameter SP. Also in this case, the critical value can be chosen such that when the second parameter reaches or passes it, pulsations start to generate or to substantially generate.

In different examples the second parameter range R corresponds to the critical value SPc of the second parameter ±10% or preferably to the critical value SPc of the second parameter ±1% or more preferably to the critical value SPc of the second parameter.

Preferably, the bottom or the top of the range corresponds to the critical value SPc of the second parameter.

The second parameter SP can be the fuel and additional fluid mass flow M or the differential pressure ΔP between a fuel and additional fluid supply and the inside of the combustion device 5. In these cases the regulation includes maintaining the total mass flow of fuel 35 and additional fluid 37 or differential pressure AP above the critical value or maintaining them within the prefixed range R.

Figure 17:
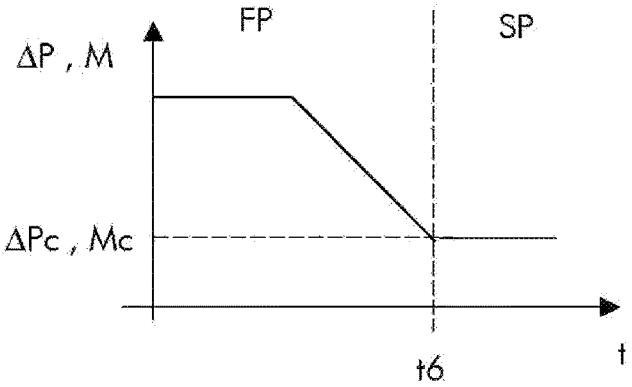

FIG. 17 shows an example in which the first and the second parameter are the same physical entity (for example mass flow M or differential pressure AP as indicated above). In this case the first parameter and the second parameter can be measured through the same sensors. In particular FIG. 17 shows that before t=t6 (i.e. when the fuel mass flow M or differential pressure ΔP between the fuel supply and the inside of the combustion device) are above the critical value Mc or ΔPc the sensors measure the first parameter and only fuel is injected and when the first parameter (i.e. M or ΔP) reaches the critical value Mc or ΔPc also the additional fluid 37 starts to be fed and the sensors measure the second parameter SP; in this example the second parameter is kept at the critical value Mc or ΔPc but as already described it can be kept above or below it or within a range R.

To measure the differential pressure ΔP the control device shown in FIG. 9 can be used.

FIG. 9 shows a control device 45 connected to sensors 46 for measuring the pressure in a line supplying the fuel (or fuel and additional fluid) to the combustion device 5 and sensors 47 for measuring the pressure within the combustion device; the control device 45 elaborates the signals from the sensors 46, 47 and provides a control signal (to a valve 48 or different component) to regulate the amount of the additional fluid 37.

The fuel 35 is supplied into the combustion device 5 via a fuel supply (for example the lance 9 or the lines 11 but, in the other examples of combustion devices 15, 25, also lance 20); the additional fluid 37 is preferably also supplied into the same fuel supply (i.e. into the lance 9 or the lines 11 or lance 20).

Advantageously, the additional fluid 37 is at least partly mixed with the fuel 35 and in this respect a mixer 49 can be provided.

The additional fluid 37 is preferably an inert fluid; inert fluid is a fluid that does not react during burning, i.e. it is neither a fuel nor an oxidizer.

In addition, when the fuel is a liquid fuel, the inert fluid is preferably a liquid fluid (for example the fuel can be oil and the additional fluid water) and when the fuel is a gaseous fuel the additional fluid is preferably a gaseous fluid (for example the fuel can be natural gas or methane and the additional fluid nitrogen).

Advantageously, since when the amount of fuel becomes low the additional flow is injected with it, no fluctuating amounts of fuel are injected into the combustion device; this prevents or hinders thermal and mechanical pulsations.

In the following some embodiments of the invention are described in detail.

EXAMPLE 1

Switch Over From a Fuel Being Premix Gas to Premix Oil

Figure 10:
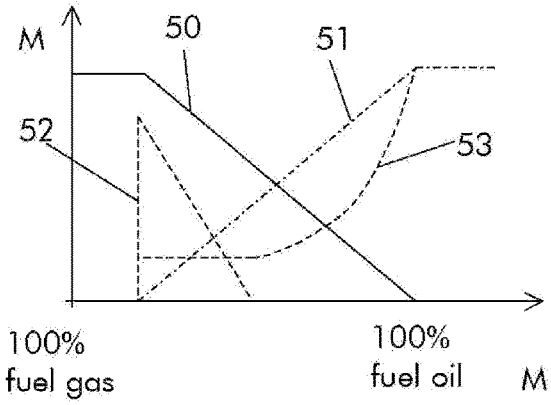
FIGS. 10 through 17 show different embodiments of the method.
Figure 11:
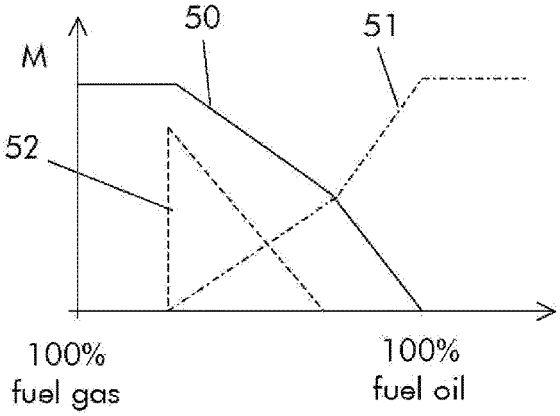
Figure 12:
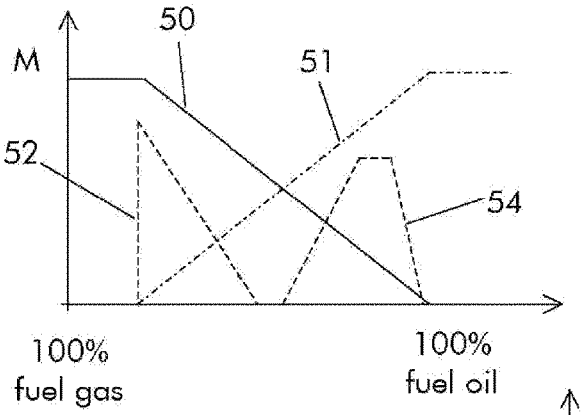
Figure 13:
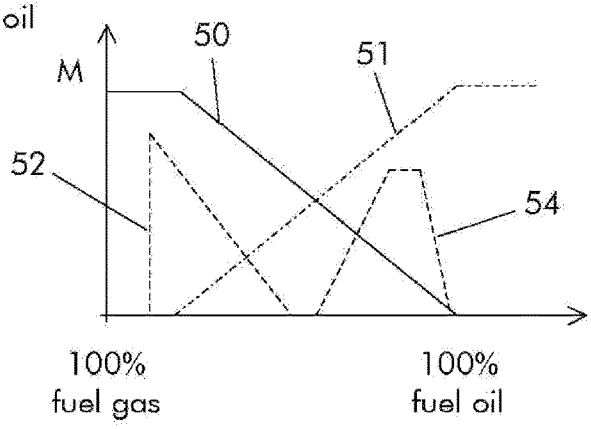

In FIG. 10 curve 50 shows the reducing amount of premix gas injected into the combustion device and curve 51 indicates the increasing amount of premix oil. In addition, curve 52 indicates the water that is supplied together with the premix oil 51 and curve 53 indicates the differential pressure as defined in the present disclosure. The amount of water is at its maximum at the beginning of its supply and then decreases. When the first parameter for the premix oil exceeds the critical amount (for example mass flow Mc or differential pressure ΔPc), the supply of water is stopped (curve 52 goes to zero). In this example, the additional fluid is only fed together with the premix oil (but not with the premix gas).

EXAMPLE 2

Switch Over From a Fuel Being Premix Gas to Premix Oil

This example is similar to the first example. In particular, in this second example two speeds for the fuel regulation are provided: a slow speed during water supply and a faster speed when no water supply is provided.

EXAMPLE 3

Switch Over From a fuel Being Premix Gas to Premix Oil

Also this example is similar to the first example and, in particular, water 52 and nitrogen 54 are supplied when a first parameter of both the gas premix and the oil premix 50, 51 are below their critical value.

EXAMPLE 4

Switch Over From a Fuel Being Premix Gas to Premix Oil

Also this example is similar to the first example and, in particular, supply of water starts before premix oil supply.

Naturally, the features described may be independently provided from one another.

In practice the materials used and the dimensions can be chosen at will according to requirements and to the state of the art.

REFERENCE NUMBERS

1 fuel mass flow at steady operation
2 theoretical fuel mass flow during transient operation
3 real fuel mass flow during transient operation
5 combustion device
6 swirl chamber
7 combustion chamber
8 front plate
9 lance
10 tangential slits
11 injectors
12 line
15 combustion device
16 body
17 inlet
19 vortex generators
20 lance
21 injectors
22 combustion chambers
25 combustion device
26 body
27 injectors
28 oxidizer injectors
30 flame
35 fuel
36 oxidizer
37 additional fluid
45 control device
46 sensor
47 sensor
48 valve
49 mixer
50 premix gas
51 premix oil
52 water
53 differential pressure
54 nitrogen
t, t0, t1, t3, t4, t5, t6 time
x axial position
ϕ, ϕ1 angular position
ΔP differential pressure
ΔPc critical value of ΔP
FP first parameter
FPc critical value of FP
G hot gases
L combustion device length
M mass flow
Mc critical value of M
P, P1, P2 pressure
R range
SP second parameter
SPc critical value of SP

What is claimed is:

1. Method for operating a combustion device comprising:

supplying a fuel and an oxidizer into the combustion device and burning them;

supplying, during at least a part of a transient operation, an additional fluid together with the fuel, the transient operation including one of a start-up of the combustion device, a switch-off of the combustion device or a fuel switch-over of the combustion device; and regulating the amount of the additional fluid to counteract combustion pulsations, wherein the additional fluid is an inert fluid, and the additional fluid is at least partly mixed with the fuel prior to injection.

2. The method according to claim 1, comprising choosing a first parameter indicative of a fuel feed and supplying the additional fluid only when the fuel feed reaches a predetermined value of the first parameter.

3. The method according to claim 2, wherein the first parameter is the fuel mass flow (M).

4. The method according to claim 3, comprising:

supplying the additional fluid only when the fuel mass flow is below a critical value at which pulsations start to generate.

5. The method according to claim 2, wherein the first parameter is a differential pressure (ΔP) between a fuel supply and the inside of the combustion device.

6. The method according to claim 2, comprising choosing a second parameter indicative of the fuel and additional fluid feed, the regulating including maintaining the second parameter above or below a second predetermined value or maintaining the second parameter within a prefixed range (R).

7. The method according to claim 6, wherein the second parameter range (R) corresponds to the second predetermined value of the second parameter ±10% or to the second predetermined value of the second parameter ±1% or to the second predetermined value of the second parameter.

8. The method according to claim 6, wherein a bottom or a top of the range (R) correspond to the second predetermined value (SPc) of the second parameter (SP).

9. The method according to claim 6, wherein the second parameter is the fuel and additional fluid mass flow (M).

10. The method according to claim 6, wherein the second parameter is the differential pressure (ΔP) between a fuel and additional fluid supply and the inside of the combustion device.

11. The method according to claim 2, wherein the predetermined value is a value at which pulsations start to generate.

12. The method according to claim 1, wherein the fuel is supplied into the combustion device via a fuel supply, wherein the additional fluid is supplied into this fuel supply.

13. The method according to claim 1, wherein the fuel is a liquid fuel and the additional fluid is also liquid.

14. The method according to claim 1, wherein the fuel is a gaseous fuel and the additional fluid is also gaseous.

15. The method according to claim 1, comprising:

supplying the additional fluid together with the fuel to create a combined flow of fluid and fuel, and the combined flow is then mixed with an oxidiser during at least a part of the transient operation.

16. The method according to claim 1, comprising:

counteracting the combustion pulsations by minimising the formation of combustion pulsations.

17. Method for operating a combustion device comprising:

supplying a fuel and an oxidizer into the combustion device and burning them;

supplying, during at least a part of a transient operation, an additional fluid together with the fuel;

regulating the amount of the additional fluid to counteract combustion pulsations; and choosing a first parameter indicative of a fuel feed and supplying the additional fluid only when the fuel feed reaches a predetermined value of the first parameter, wherein the first parameter is a differential pressure (ΔP) between a fuel supply and the inside of the combustion device.

18. Method for operating a combustion device comprising:

supplying a fuel and an oxidizer into the combustion device and burning them;

supplying, during at least a part of a transient operation, an additional fluid together with the fuel;

regulating the amount of the additional fluid to counteract combustion pulsations;

choosing a first parameter indicative of a fuel feed and supplying the additional fluid only when the fuel feed reaches a predetermined value of the first parameter;

choosing a second parameter indicative of the fuel and additional fluid feed, the regulating including maintaining the second parameter above or below a second predetermined value or maintaining the second parameter within a prefixed range (R); and wherein the second parameter prefixed range (R) corresponds to the second predetermined value of the second parameter ±10% or to the second predetermined value of the second parameter ±1% or to the second predetermined value of the second parameter.

* * * * *